US012156594B2

(12) United States Patent
Hutmacher et al.

(10) Patent No.: US 12,156,594 B2
(45) Date of Patent: Dec. 3, 2024

(54) SOFA BED WITH GLIDE SYSTEM

(71) Applicant: LIPPERT COMPONENTS MANUFACTURING, INC., Elkhart, IN (US)

(72) Inventors: Patrick Hutmacher, Grayslake, IL (US); Chuanrong Heng, Chaohu (CN)

(73) Assignee: LIPPERT COMPONENTS MANUFACTURING, INC., Elkhart, IN (US)

( * ) Notice: Subject to any disclaimer, the term of this patent is extended or adjusted under 35 U.S.C. 154(b) by 0 days.

(21) Appl. No.: 17/853,077

(22) Filed: Jun. 29, 2022

(65) Prior Publication Data

US 2022/0322836 A1 Oct. 13, 2022

Related U.S. Application Data

(62) Division of application No. 17/115,793, filed on Dec. 9, 2020.

(51) Int. Cl.
*B60P 3/38* (2006.01)
*A47C 17/165* (2006.01)
(Continued)

(52) U.S. Cl.
CPC ..... *A47C 17/1655* (2013.01); *A47C 17/17* (2013.01); *A47C 17/20* (2013.01)

(58) Field of Classification Search
CPC ... A47C 17/161; A47C 17/162; A47C 17/163; A47C 17/165; A47C 17/1655;
(Continued)

(56) References Cited

U.S. PATENT DOCUMENTS 910,952 A * 1/1909 Phillipson ..... A47C 17/161 297/114
2,648,071 A 8/1953 Reilly
(Continued)

FOREIGN PATENT DOCUMENTS

RU 206 852 9/2021
WO WO 2005/089595 9/2005

OTHER PUBLICATIONS

Ballister, "How to Extend and Retract RV Slideouts," Camping World, available at https://blog.campingworld.com/learn-to-rv/how-to-extend-and-retract-rv-slide-outs/. Dec. 19, 2022.
(Continued)

*Primary Examiner* — Justin C Mikowski
*Assistant Examiner* — Ifeolu A Adeboyejo
(74) *Attorney, Agent, or Firm* — NIXON & VANDERHYE P.C.

(57) ABSTRACT

A sofa bed with three moving seat bases that transforms between a bed configuration and a sofa configuration. The sofa bed includes supporting legs and armrest. The armrest does not extend to the floor and allows the set of rails to form a notch such that the back end of the sofa bed may be installed on a raised area. Each of the seat bases, and corresponding cushions, are located between the armrests. The seat bases are interconnected with a set of slide rails that allow the seat bases to move relative to one another. The sofa bed also includes a locking mechanism to hold the sofa bed in the sofa configuration.

20 Claims, 8 Drawing Sheets

(51) Int. Cl.
*A47C 17/17* (2006.01)
*A47C 17/20* (2006.01)
*B60N 2/24* (2006.01)

(58) Field of Classification Search
CPC ..... A47C 17/17; A47C 17/1753; A47C 17/20; A47C 17/213; B60P 3/38; B60N 3/008; B60N 2/34
See application file for complete search history.

(56) References Cited

U.S. PATENT DOCUMENTS 2,730,727 A * 1/1956 Schneller ..... A47C 17/161 5/47
3,385,631 A * 5/1968 Gertler ..... A47C 17/22 297/111
3,634,893 A * 1/1972 Hern ..... A47C 17/17 5/47
4,204,287 A * 5/1980 Lane ..... A47C 17/22 5/13
4,402,096 A * 9/1983 Atimichuk ..... A47C 17/161 5/17
4,608,722 A * 9/1986 Zorzetto ..... A47C 17/161 5/13
4,860,393 A 8/1989 Schefthaler
5,038,422 A 8/1991 Messina
5,101,524 A 4/1992 Brandschain
5,913,770 A * 6/1999 Tseng ..... A47C 17/17 5/52
6,427,262 B1 8/2002 Huang
6,601,920 B1 8/2003 Magyar
6,739,651 B1 5/2004 Barefoot
6,904,628 B2 6/2005 Murphy et al.
6,918,143 B2 7/2005 Wiberg
6,986,175 B2 1/2006 Maas
7,383,596 B2 6/2008 James et al.
7,748,061 B2 7/2010 Pine
7,945,974 B2 5/2011 Cabrera et al.
8,123,288 B2 2/2012 Murphy et al.
8,225,438 B2 7/2012 Murphy
8,464,370 B2 6/2013 Beck et al.
8,931,126 B1 1/2015 Xu
9,119,475 B1 9/2015 Leal et al.
9,468,303 B2 10/2016 Garland
9,591,928 B2 3/2017 Martinez
9,888,781 B2 2/2018 Wallis
9,980,572 B2 5/2018 Thurow
2007/0283491 A1 12/2007 Murphy
2008/0092290 A1* 4/2008 Cabrera ..... A47C 17/132 5/47
2009/0146469 A1* 6/2009 Reynolds ..... A47C 17/20 297/118
2016/0262546 A1* 9/2016 Cassaday ..... A47C 17/161
2019/0100119 A1 4/2019 Neterer et al.
2020/0054143 A1 2/2020 Garland

OTHER PUBLICATIONS

European Search Report dated Nov. 29, 2023 issued in European Patent Application No. 20899100.0, 6 pp.
PCT International Search Report dated Mar. 12, 2021 issued in PCT International Patent Application No. PCT/US20/63855, 3 pp.

* cited by examiner

SOFA BED WITH GLIDE SYSTEM

CROSS REFERENCE TO RELATED APPLICATIONS

This application is a divisional of U.S. patent application Ser. No. 17/115,793, filed on Dec. 9, 2020, which claims the priority benefit of Chinese Utility Model Patent Application No. CN201922193208.0U filed on Dec. 9, 2019, now Chinese Utility Model Patent Grant No. CN211632507U.

FIELD OF THE INVENTION

The present invention relates to convertible furniture. More specifically, it relates to sofas that convert between sitting and sleeping configurations.

BACKGROUND OF THE INVENTION

Sofas are commonly sold as sitting furniture that allows more people to comfortably sit side-by-side as compared to other furniture, such as an individual chair. Sofas range in size from small two-person love seats to large couches that can hold four or more people. Some sofas include mechanisms that allow the seat portion to unfold outward and forward to convert into a bed. This combination is commonly called a "sleeper sofa", "stowaway sofa", or "sofa bed".

Sofa beds provide the convenience of a dual-purpose piece of furniture, and there are several kinds, each with their own sets of components assembled to realize a mechanism that switches the sofa bed between the sofa and bed configurations. These component assemblies mean that sofa beds may have complicated internal construction assemblies. These assemblies may be made up of metal tubes, attachments, and other metal members.

A shortcoming of existing sofa beds it that the internal assemblies result in high manufacturing costs. Another shortcoming is that the internal assemblies may weigh so much that the sofa bed is difficult to move around or lift for the average person. Another shortcoming is that the internal assemblies may include so many components that they are subject to easy damage or breakage. Further, the internal assemblies may be difficult and costly to repair.

What is needed is a sofa bed that has a simplified internal assembly that reliably transitions the sofa bed between the bed and sofa configurations. What is also needed is an internal assembly that is lightweight so that the sofa can be easily moved. What is also needed is an internal assembly that is conducive to repair and resistant to damage.

SUMMARY OF THE DISCLOSURE

The present invention is an apparatus for use as a convertible sleeping and sitting surface. Specifically, the apparatus is a sofa bed with an enhanced glide apparatus for transitioning between the sofa and bed configurations.

One embodiment of the present disclosure is sofa bed that includes a pair of armrests; at least one first seat cushion disposed between the pair of armrests; at least one first connector attached to each of the at least one first seat cushion; at least one second seat cushion disposed between the pair of armrests; at least one second connector attached to each of the at least one second seat cushion, wherein the at least one first connector and the at least one second connector form a hinge joint; at least one third seat cushion disposed between the set of armrests; a first seat base attached to the at least one first seat cushion; a pair of stand bars supporting the first seat base; a second seat base attached to the at least one second seat cushion; a third seat base attached to the at least one third seat cushion, wherein the second seat base and the third seat base are connected in a hinge joint; a pair of rotating shafts, each disposed in one of the armrests, wherein the third seat base is attached to the rotating shafts opposite the hinge joint with the second seat base; a pair of support legs configured to support the second seat base; a pair of first slide rails, each attached to one of the pair of support legs; a pair of first glide wheels, each connected to at least one of the first connectors, wherein each of the first slide rails is configured to receive the first glide wheel and allow it to roll along at least part of the length of the first slide; a pair of second slide rails, each attached to one of the pair of armrests; and a pair of second glide wheels, each of the second glide wheels connected to one of the support legs, wherein each of the second slides is configured to receive the second glide wheel and allow it to roll along at least part of the length of the second slide. The sofa bed may also include a locking mechanism. Where the first seat base has a side distal to the second seat base and a side proximal to the second seat base and the second seat base includes a protrusion opposite the second seat cushion, the locking mechanism may include a pair of reinforcing rods, each with a first side and a second side, wherein the each of the first sides is attached to the corresponding distal side of the first seat base and each of the second sides is attached to the corresponding proximal side of the first seat base; a pair of ratchet brackets, each comprising an L-shaped bar with a long side and short side and comprising indentations along the long side, the short side being attached to the reinforcing rod and the long side being attached to the proximal side of the first seat base; a pair of locking rods, each with one end attached to the corresponding protrusion on the second seat base and the other end engaging the teeth of the ratchet bracket; and a pair of slider stops, each surrounding a long side of one of the ratchet brackets and comprising a spring between the slider stop and the locking rod to apply force to maintain engagement between the teeth and the locking rod. The sofa bed may also include a support pad disposed on each of the first slides to support the second seat base and the third seat base. The sofa bed may also include a pair of first casters, each on one of the stand bars; and a pair of second casters, each on one of the support legs. The third seat base may include a pair of connection plates and each of the rotating shafts may connect to the third seat base at one of the connection plates.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE DISCLOSURE

Figure 1:
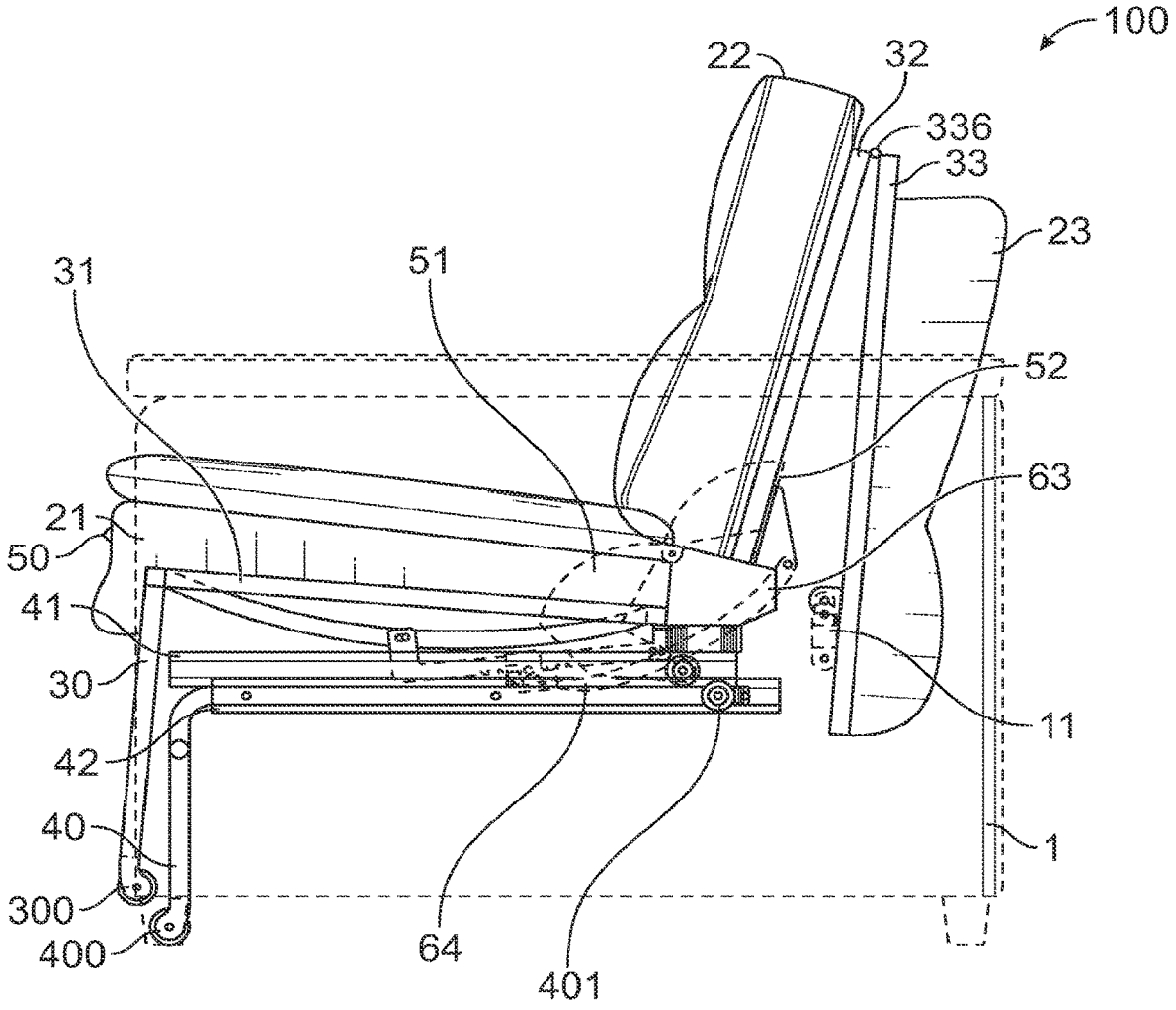
FIG. 1 is a side view diagram of a sofa bed in a sofa configuration according to one embodiment of the present disclosure.

While this invention may be susceptible to embodiment in different forms, specific embodiments are shown in the drawings and will be described herein in detail with the understanding that the present disclosure is to be considered an exemplification of the principles of the invention and is not intended to limit the invention to that as illustrated.

Figure 2:
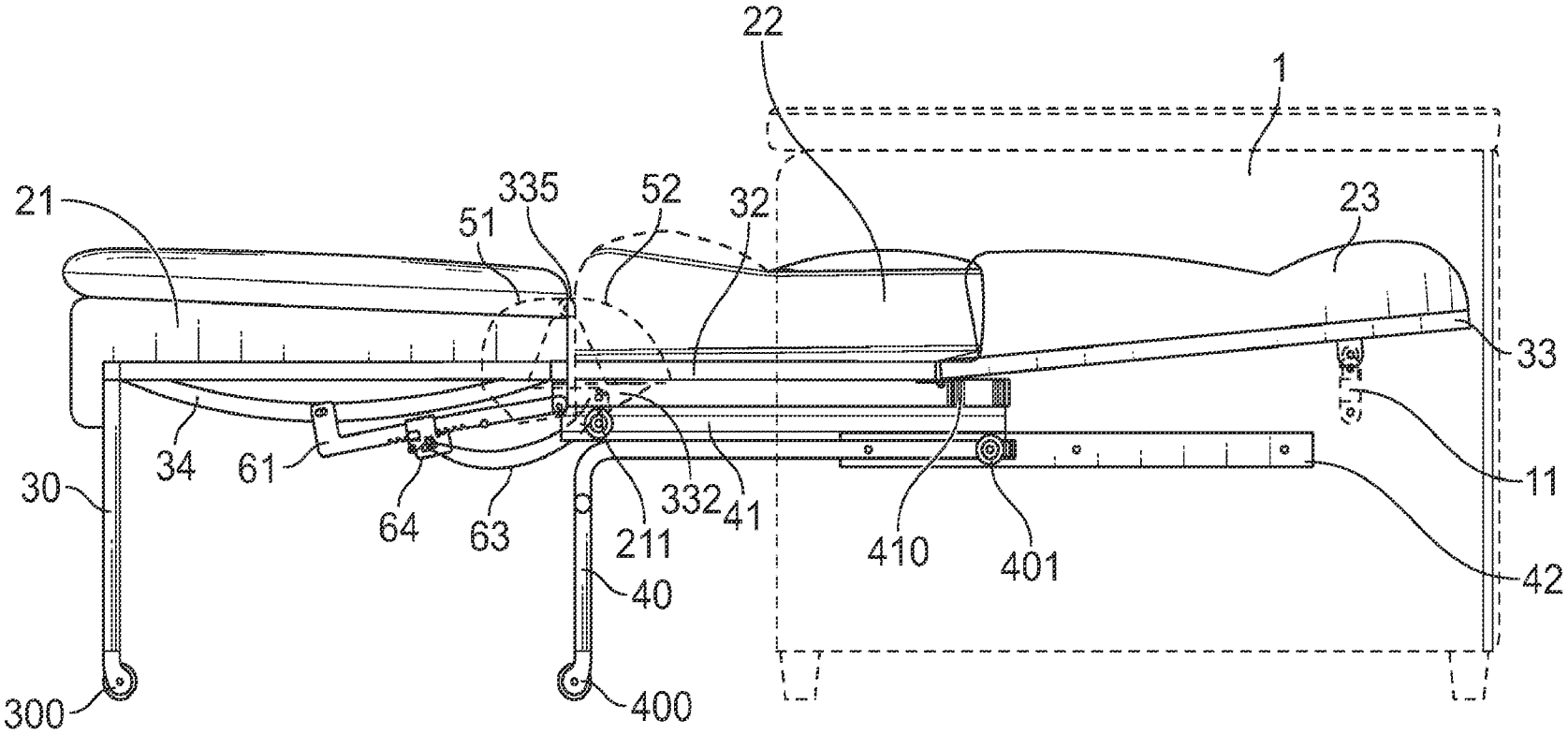
FIG. 2 is a side view diagram of the sofa bed of FIG. 1 in a bed configuration.
Figure 3:
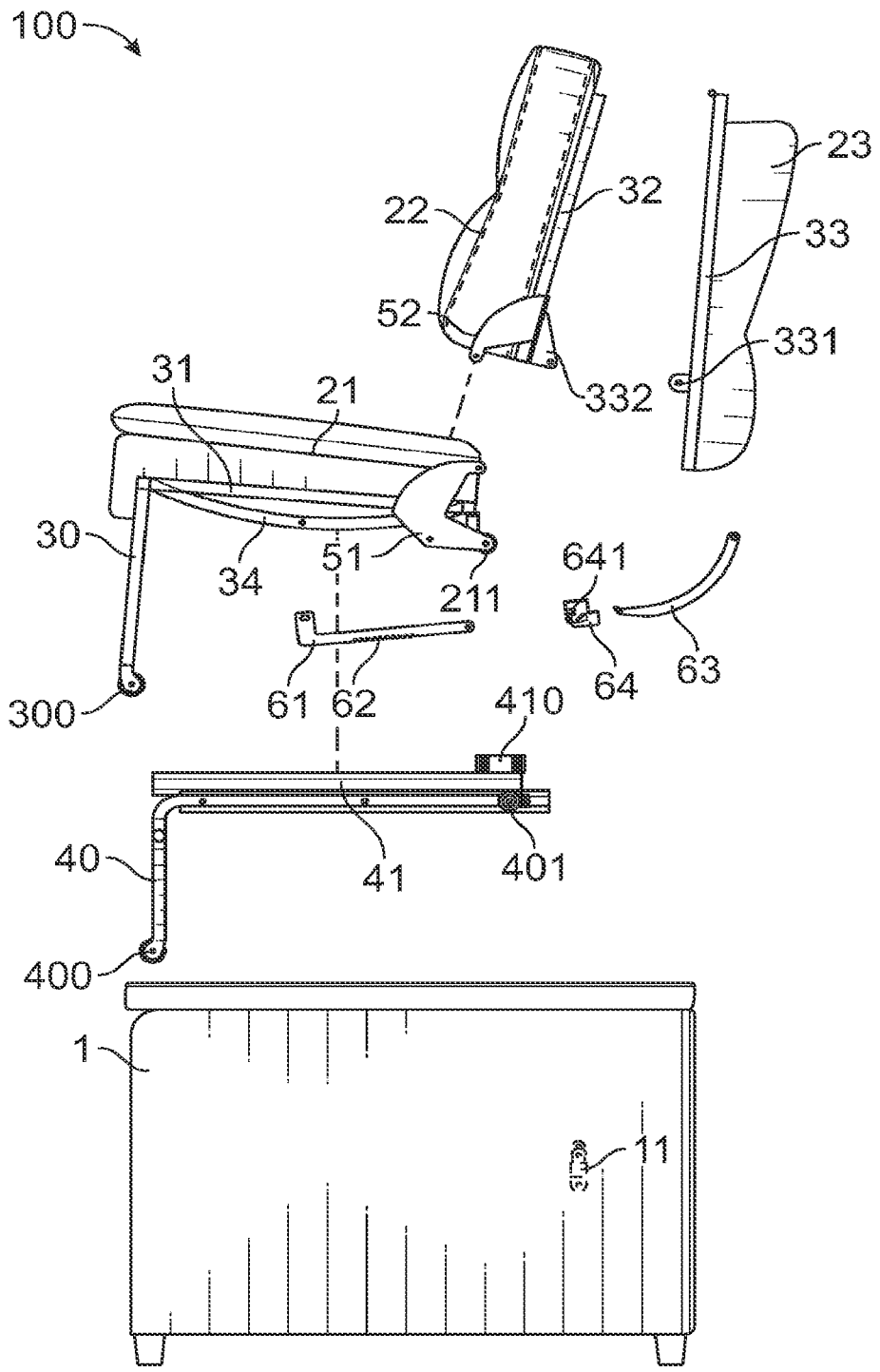
FIG. 3 is an exploded view of the sofa bed of FIG. 1.

FIGS. 1-3 show diagrams of the sofa bed 100 according to one embodiment of the present disclosure. FIG. 1 shows a side view of the sofa bed 100 includes armrests 1, a first seat cushion 21, a second seat cushion 22, a third seat cushion 23, a first seat base 31, a second seat base 32 and a third seat base 33. The armrest 1 is constructed with an internal metal frame that may be wrapped with foam and polyurethane leather or other suitable upholstery material. The armrests 1 are disposed on the left and right sides of the sofa bed 100.

The parts of this disclosure may be discussed in singular or paired fashion, as one side of the sofa bed 100 would be understood by a person of skill in the art to have symmetry between the parts on each side but may have singular or paired parts between pairs of other parts. For example, a person of skill in the art would understand that a sofa has two armrests. Also, a person of skill in the art would understand that a sofa may be designed to have a pair of cushions or a single long cushion.

The first seat cushion 21, the second seat cushion 22, and the third seat cushion 23 are disposed between the pair of armrests 1. The seat cushions 21, 22, 23 may be constructed of a plywood or metal base 31, 32, 33 that is wrapped with foam and polyurethane leather. Each of the first seat base 31, the second seat base 32, and the third seat base 33 correspond to one of the seat cushions 21, 22, 23. Each seat base 31, 32, 33 is disposed on one side of corresponding seat cushion 21, 22, 23 opposite from where a user would come in contact with the seat cushions 21, 22, 23 during normal use of the sofa bed 100.

A first connector 51 is attached to the first seat cushion 21 and a second connector 52 is attached to the second seat cushion 22. The first connector 51 and the second connector 52 are attached to each other by a fastener that acts as a hinge 335 and allows the two connectors 51, 52 to rotate relative to each other such that the first seat cushion 21 and the second seat cushion 22 can move relative to one another to jointly form a substantially planar surface in the bed configuration and at least one of: an acute, right, or obtuse angle in sofa configuration as would be understood by a person of skill in the art. Connectors 51, 52 may comprise a crescent hinge.

The first seat base 31 may be made of metal. A reinforcing rod 34 may be attached to the first seat base 31. The reinforcing rod 34 may be bent or curved rather than straight. Each of the ends of the reinforcing rod 34 may be connected proximate to or at the ends of the first seat base 31. The reinforcing rod 34 may be made of metal as well.

The first seat base 31 may be supported by two stand bars 30. Each of the stand bars may be connected on one end to the first seat base 31 and have a first caster 300 attached on the other end for contact with a floor surface, such that the first seat base 31 will roll on the floor when moved toward or away from the rest of the sofa bed 100. The first seat base, viewed from the side, may be L-shaped. The short side of the L-shaped may be used as an attachment point for part of the ratchet or locking system 500 discussed further below.

As with the first seat base 31, the second seat base 32 and the third seat base 33 may also be made of metal or another suitable material that provide structural support and attachment points for the other components. A hinge 336 may connect the side of the second seat base 32 distal from the first seat base 31 with one side of the third seat base 33.

FIG. 3 shows an exploded side view of the sofa bed 100. The third seat base 33 may include a hump or connection plate 331 on its underside and distal from the second seat base 32 and hinge 336. The armrest 1 may have rotating shaft 11 or axle attached to it. The connection plate 331 includes an opening through which part of the rotating shaft 11 may be inserted, such that the third seat base 33 can rotate about the rotating shaft 11 and change its orientation relative to the armrest 1.

As seen in FIG. 2, which is a side view of the sofa bed 100 in the bed configuration, the rotation of the seat bases 31, 32, 33 relative to one another on their respective hinges allows the sofa bed 100 to move from the sofa configuration to the bed configuration. The second seat cushion 22 and the third seat cushion 23 that were facing in opposite directions relative to their seat bases 32, 33 from each other FIG. 1 are now facing in the same direction in FIG. 2. The rotating shaft 11 allows the third seat cushion 23 to move relative to the armrest 1 by rotating but remain fixed at the point of the rotating shaft 11.

When shown in the sofa configuration, it can be seen that the sofa bed 100 includes a system for sliding and locking the seat bases 31, 32, 33 so that the sofa bed 10 can be transitioned between the sofa configuration and the bed configuration.

A support leg 40 may be attached to a first slide 41 and a second slide 42. The support leg may be metal and L-shaped. A vertical portion of the support leg 40 may have a second caster 400 disposed on its end between the support leg 40 and the floor surface. The first slide 41 is a slide rail attached to the top of the horizontal portion of the support leg 40. A first glide wheel 211 may be attached to the first connector 51 in a position where the first glide wheel 211 is received by the first slide 41 and can roll along with the first slide 41.

A support pad 410 may be disposed on top of the first slide 41 to support the second seat base 32 and the third seat base 33 when the sofa bed 100 is in the bed configuration. The second slide 42 is a slide rail attached to the armrest 1. The horizontal portion of the support leg 40 may have a second glide wheel 401 disposed along its length that can roll along the length of the second slide 42. In some embodiments, the second glide wheel 401 may be attached to the first slide 41.

The locking system 500 may include a ratchet bracket 61 with teeth 62, a locking rod 63, a slider stop 64, and first and second hinge joints 434, 436. The ratchet bracket 61 may be metal and L-shaped, with the teeth 62 disposed along the long part of the L. The teeth are made up of indentations in the ratchet bracket 61 and define positions along the length of the long side. One end of the ratchet bracket 61 is connected to the reinforcing rod 34, and the other end is connected to the first seat base 31. Alternative fastening mechanisms may be used.

The second seat base 32 includes a protrusion 332 on its underside proximal to the first seat base 31. Similarly, the first seat base 31 may include a protrusion or bracket to which first hinge joint 434 is connected at the underside of base 31. The protrusion 332 includes an opening for forming a hinge joint 436. The locking rod 63 is a bent metal bar with one end connected to the protrusion 332 at the hinge joint 436. The other end of the locking rod 63 is positioned to engage at least one of the teeth 62. The slider stop 64 is metal and surrounds part of the long side of the ratchet bracket 61. The slider stop 64 is configured to slide along one side of the ratchet bracket 61 and assist in the engagement of the locking rod 63 with the teeth 62. A spring 641 is attached between the slider stop 64 and the end of the locking rod 63 proximal to the slider stop 64. The force from the spring 641 holds the locking rod 63 engaged with at least one of the teeth 62 unless acted on by another force.

Figure 4:
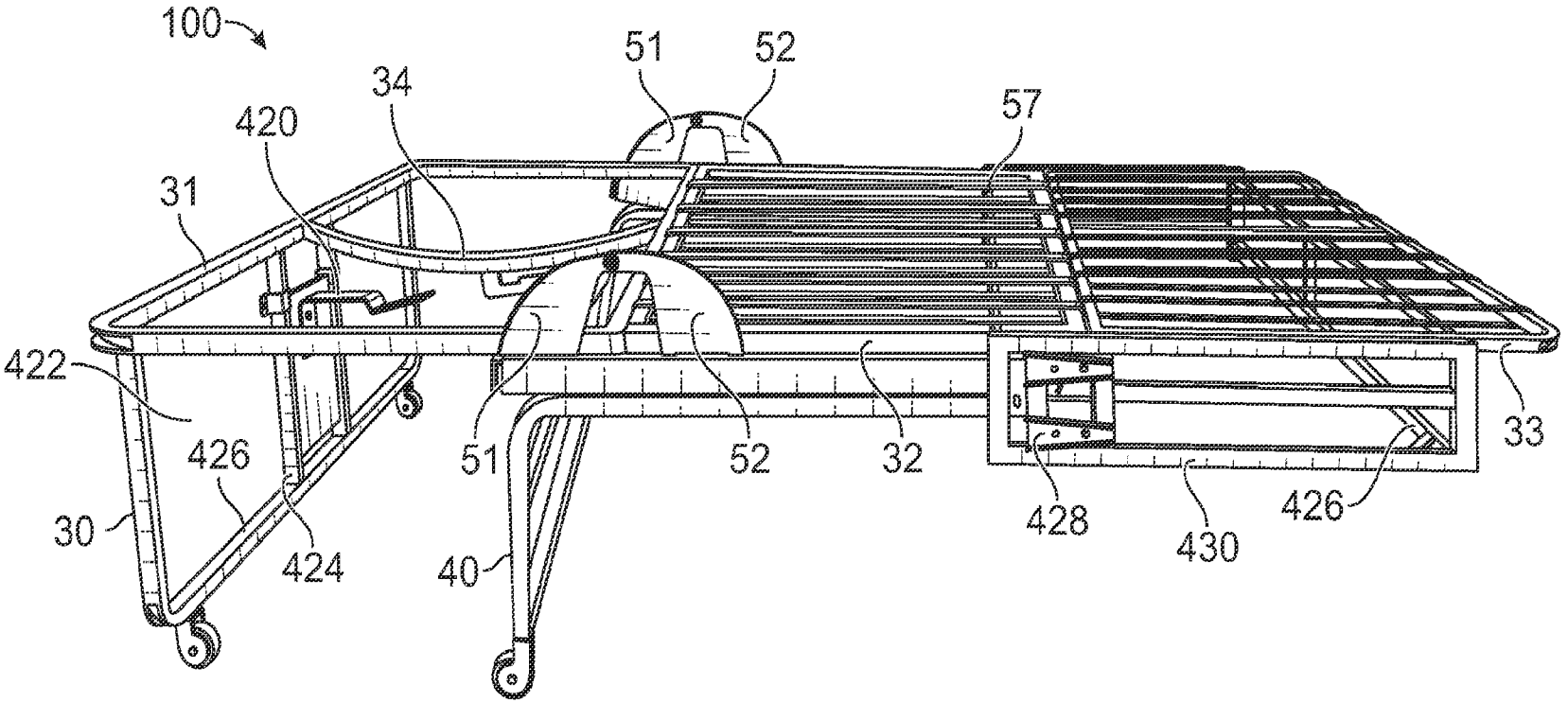
FIG. 4 is a side perspective view diagram of the sofa bed of FIG. 1 in a bed configuration without cushions or armrests.
Figure 5:
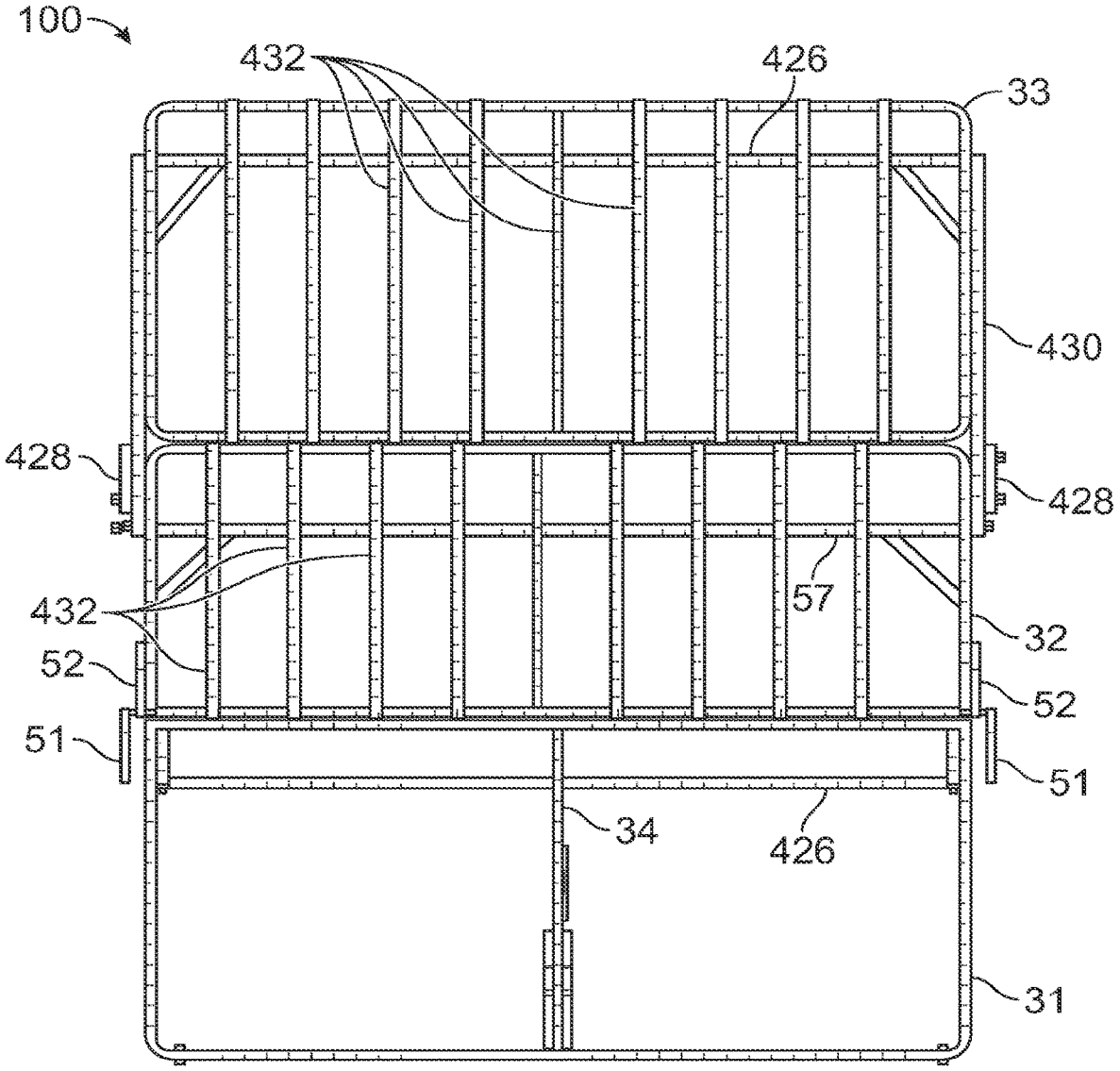
FIG. 5 is a side perspective view diagram of the sofa bed of FIG. 1.

FIGS. 4 and 5 shows sofa bed 100 without any cushions 21, 22, 23 or armrests 1. As shown, the sofa bed 100 comprises first, second, and third seat bases 31, 32, 33, stand bars 30, reinforcing rod 34, support leg 40, first and second connectors 51, 52, ratchet bracket 61, clip 420, backing support 422, vertical supports 424, lateral supports 426, armrest bracket 428 (which is attached to the armrest 1), box frame 430, and cross supports 432.

Figure 6:
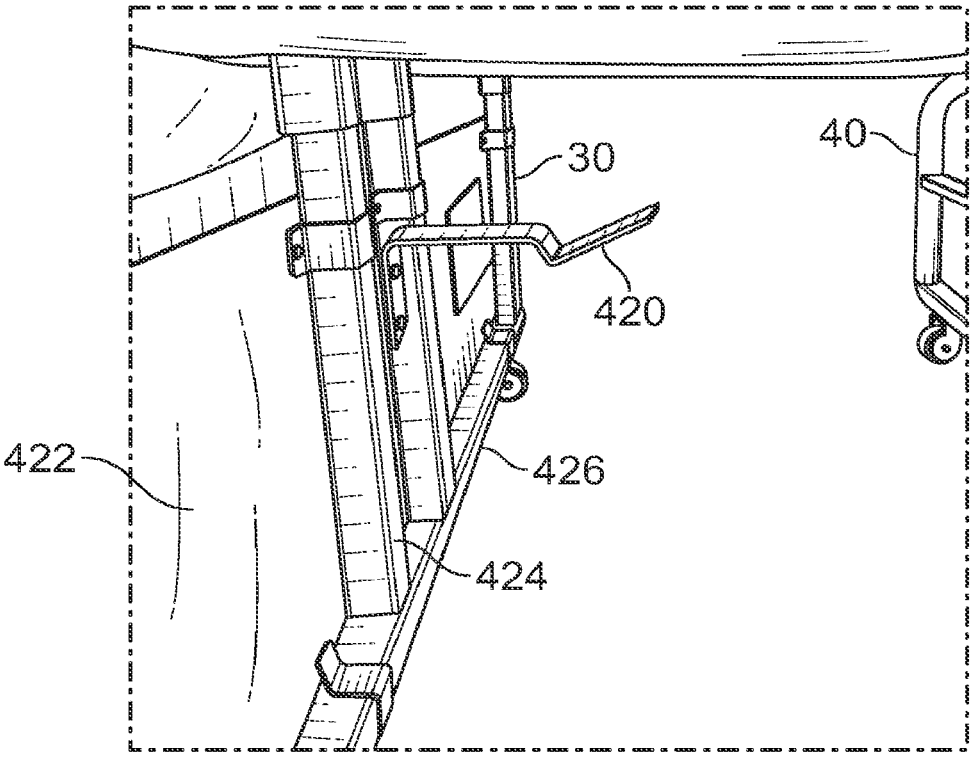
FIG. 6 is a side view diagram of a clip of the sofa bed of FIG. 1.

As shown in FIG. 6, the vertical supports 424 are complementary to the stand bars 30 and preferably extend from the first seat base 31 to lateral support 426 as shown in FIG. 4. The clip 420 is preferably attached to the backing support 422 and/or the vertical supports 424 using a suitable fastener. When the sofa bed 100 is in the sofa configuration, the clip 420 will deflect and lock on to strut or crossbar 57 which helps to keep the sofa bed 100 in the sofa configuration. This is particularly useful for installations of sofa bed 100 in moving vehicles, such as recreational vehicles, to keep the sofa bed 100 from opening while the vehicle is in motion due to vibration and comparable forces. Alternative fastening mechanisms may be used to maintain the sofa bed 100 in the sofa configuration. The locking system 500 may be spring loaded and thus biased toward the bed configuration. The crossbar 57 is preferably stationary.

Figure 7:
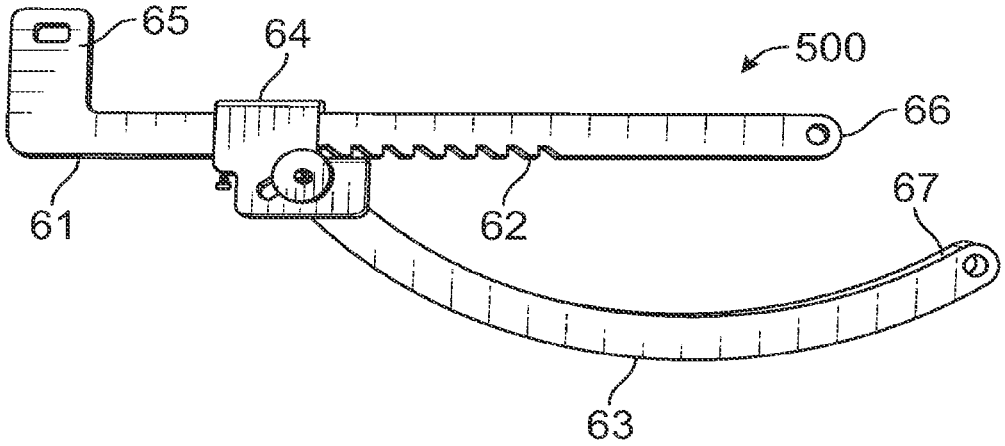
FIG. 7 is a diagram of a locking system of the sofa bed of FIG. 1.
Figure 8:
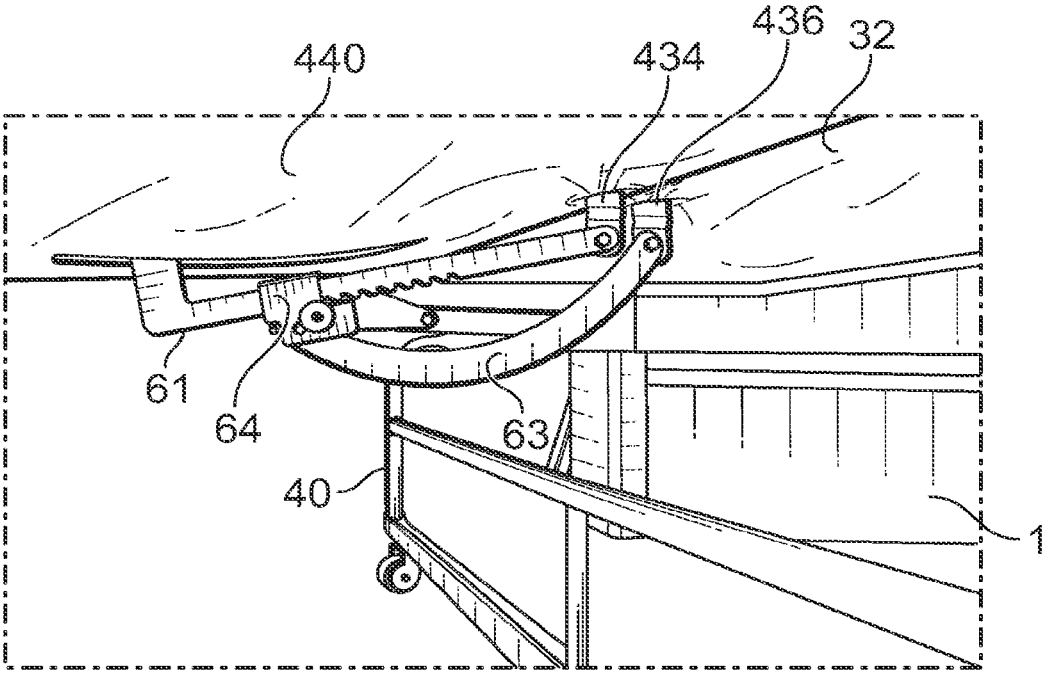
FIG. 8 is a side perspective view diagram of a locking system of FIG. 7 attached to the sofa bed of FIG. 1 in a bed configuration.
Figure 9:
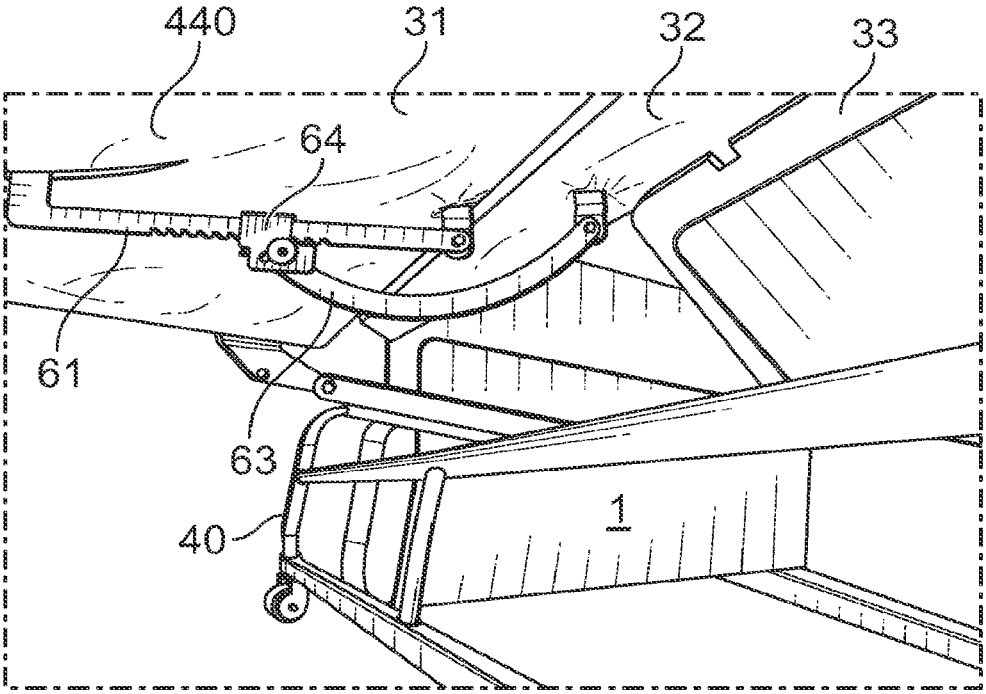
FIG. 9 is a side perspective view diagram of a locking system of FIG. 7 attached to the sofa bed of FIG. 1 in an intermediate configuration between sofa and bed.

As shown in FIGS. 7-9, the structure and function of the locking system 500 is depicted including first hinge joint 434 connected to first seat base 31 and second hinge joint 436 connected to second seat base 32. FIG. 8 shows the sofa bed 100 in the sofa configuration. In this configuration, slider stop 64 is positioned toward first end 65. When the sofa bed 100 is moved from the bed configuration to the sofa configuration, the slider stop will move along ratchet bracket 61 and teeth 62 toward second end 66, as shown in FIG. 9. Additionally, as ratchet bracket 61 preferably moves in tandem with first and second connectors 51, 52, that is, as the sofa bed 100 is moved from bed to sofa configurations, and vice versa, the bracket 61 will move in tandem with first and second connectors 51, 52. The first and second connectors 51, 52 preferably rotate/slide past and do not interfere with each other as the sofa bed 100 opens and closes. As best shown in FIG. 5, first and second connectors 51, 52 are preferably offset.

Figure 10:
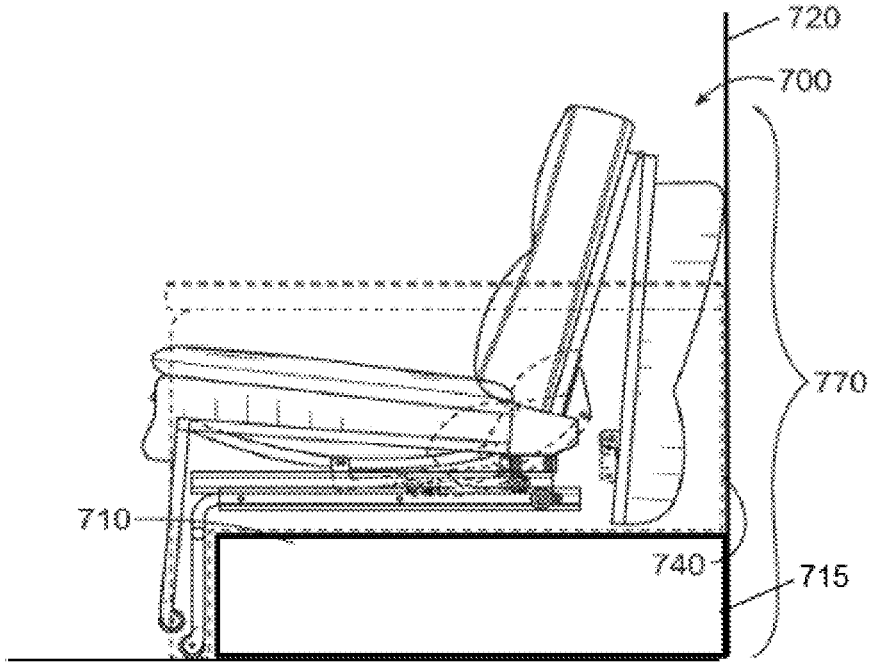
FIG. 10 is a side view of a sofa bed provided in accordance with an alternative preferred embodiment of the present invention.

FIG. 10 shows alternative sofa bed 700, which is substantially the same as sofa bed 100. The difference depicted in FIG. 10 is notch or gap 710, wherein the armrest 1 structure does not extend to the floor, as shown in FIG. 1. Notch 710 allows sofa bed 700 to be installed on a raised and/or movable surface 715, such as a slide-out floor in a recreational vehicle (RV). The notch 710 may vary in height, preferably from 1 to 12 inches for most applications, and, consequently, the lower-most height of the mechanism of sofa bed 100, 700 is complementary to the height of the notch 710. Traditional sofa beds cannot comprise a notch 710 because the mechanism of such beds occupies the space of notch 710 because such prior art mechanisms are installed near the bottom of the sofa (i.e., substantially adjacent to the floor). In that way, the overall distance from the floor to the seat or bed of sofa bed 700 is reduced, as compared to a sofa bed lacking the notch 710. This improves the safety and accessibility of sofa bed 700, particularly in RV applications. The overall height of sofa bed 700 in RV installations may be adjusted, i.e., using different notch 710 sizes, spacers, or slide-out floor heights and/or elevations to accommodate a desired sofa bed 700 of a user.

Figure 11:
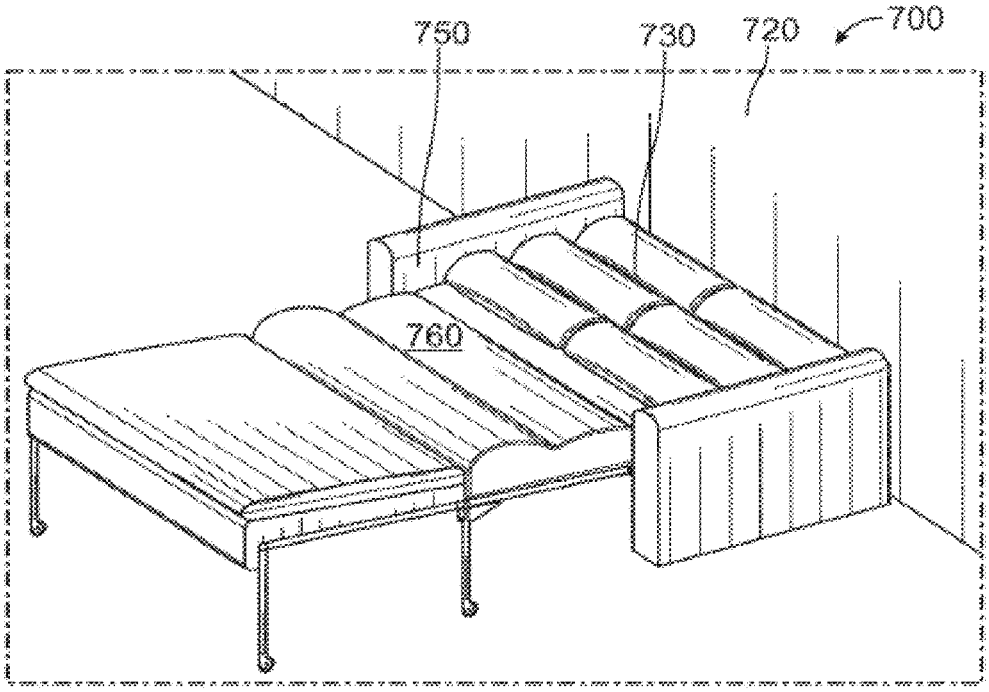
FIG. 11 is a perspective view of a sofa bed provided in accordance with an alternative preferred embodiment of the present invention.

FIG. 11 shows sofa bed 100 or 700, wherein third seat cushion 23, 730 preferably extends to a position that is substantially flush with the back 740 of armrest 1, namely, the portion depicted in position against or adjacent to wall 720 in FIG. 11. Like the notch 710, this feature is particularly advantageous in RV applications where space is limited. For example, sofa bed 100, 700 may be installed against a wall 720 of an RV, wherein it is desirable for there to be no space wasted between the back 740 and the wall 720 when the sofa bed 100, 700 is in the bed configuration as shown. Such installations are also applicable in small spaces other than RVs.

In operation from the sofa configuration to the bed configuration, the seat base 31 may be lifted vertically by way of an optional handle 50 or similar device preferably connected to base 31 or backing support 422. FIG. 1 shows sofa bed 100 and base 31 in a slightly lifted position in preparation for extension into the bed configuration. By lifting base 31, the clip 420 is released from crossbar 57 and the sofa bed 100 may extend from the sofa configuration shown in FIG. 1 to the bed configuration shown in FIG. 2. During deployment of the sofa bed 100 into the bed configuration, the slider stop 64 will move along ratchet bracket 61 from the second end 66 toward the first end 65. Moreover, the combination of rotating shaft 11, hinge 336, connectors 51, 52 in cooperation with hinge 335, first glide wheel 211 in first slide 41, second glide wheel 401 in second slide 42 and preferably first and second casters 300, 400 enable the sofa bed 100 to smoothly glide outwardly from a sofa configuration to a bed configuration as a user pulls gently on the handle 50. Additionally, locking rod 63 will generally coax the movement of second seat base 32 by way of the connection of end 67 to second hinge joint 436. Once the sofa bed 100 is fully deployed in the bed configuration, the slider stop 64 will be preferably disengaged from teeth 62.

To move the sofa bed 100 back into the sofa configuration, the seat base 31 is preferably once again lifted vertically by way of an optional handle 50. This will engage the slider stop 64 with the teeth 62. As best shown in FIG. 9, movement toward the sofa configuration will cause the slider stop 64 to move toward end 66, as locking rod 63 pushes upwardly on second hinge joint 436 connected to protrusion 332 of second seat base 32. As shown, this pushes second seat base 32 and third seat base 33 into a substantially A-frame intermediate configuration, wherein the third seat cushion 23 is substantially tucked away in the armrest 1, and second seat cushion 22 once again becomes a substantially vertical support surface for sitting, and first seat cushion 21 becomes a substantially horizontal surface for sitting. When the sofa bed 100 is fully returned to the sofa configuration, the clip 420 will connect with crossbar 57 and hold the sofa bed 100 in the sofa configuration until bed deployment is once again desired.

As shown in the figures and described above, sofa bed 100, 700 provides numerous advantageous and unique features over the prior art. A standard sofa bed has its mechanism placed beneath the seats of the sofa, and the seat cushions must be removed to open the metal mechanism. The mechanism of sofa bed 100, 700 is preferably not placed beneath the seat base 31; it actually includes the seat bases 31, 32, 33 and corresponding cushions 21, 22, 23 as part of the bed. Thus, the cushions 21, 22, 23 do not need to be removed and stored while the sofa bed 100, 700 is in use in any configuration. The sofa bed 100, 700 has first and second sets of casters or wheels 300, 400 that allow the sofa bed 100, 700 to be moved in a single continuous motion when it is open or closed. The back of sofa bed 100, 700 is preferably a double-sided cushion 22, 23 mechanism that allows it to fold flat to become part of the bed surface, as shown in FIGS. 1, 2. It is easy for anyone to use and does not require the cushions 21, 22, 23 to be removed. A traditional trifold sleeper has a large fold down back "flap" that becomes a part of the mattress, but is harder to reach and fold back up, and it is one more step to operate as compared to the advantageous sofa bed 100, 700. A traditional sofa bed mechanism is attached to the inside of the arms which takes up about 8-10 inches of width on each side, thus reducing the sleeping space of the mattress or making the entire sofa width wider. As shown in the figures, the sofa bed 100, 700 mechanism is attached very closely to the inside 750 of armrests 1 allowing for little clearance and a wider sleeping and sitting surface 760 on a sofa bed 100, 700 that may have a greater ratio of surface 760 width to overall sofa bed 100, 700 width, as compared to such ratios of traditional sofa beds.

The sofa bed 100, 700 comprises the seat bases 31, 32, 33 that all extend and revert together as a single unit to form the sleep surface 760. The back height 770 and sleep surface 760 of sofa bed 100, 700 can be adjusted in production or by a user to fit tight areas. A standard sofa bed mechanism also requires about 12 inches of clearance from the sofa back to move upward for the mattress storage, whereas as the sofa bed 100, 700 mechanism can be very close to the wall 720 at all times, thus allowing for a longer mattress that is closer to the wall 720 and consequently conserves space as compared to traditional mattresses that extend further into the space where the sofa bed is installed. This feature of sofa bed 100, 700 is particularly advantageous in tight spaces such as RVs. The sofa bed 100, 700, has a built in "lock" position that keeps the unit from opening when it is in the seat configuration, the lock position being facilitated by the interaction of the clip 420 and strut 57. To open the sofa bed 100, 700 into the bed configuration, handle 50 may be grasped and the seat base 31 lifted upwardly a few inches such that the clip 420 and locking mechanism 500 will release. The handle 50 may be lowered and gently pulled outwardly, such that the casters 300, 400 bear the weight of the sofa bed 100, 700 as the sofa bed 100, 700 gently rolls out into the bed configuration. To close the sofa bed 100, 700, the handle 50 may be grasped again and the base 31 lifted upwardly between preferably 1 to 10 inches from the floor to engage the locking mechanism 500. In normal operation, an audible "click" may be heard, indicating that the locking mechanism 500 is engaged. This will cause the adjacent edges of bases 32, 33 to move upwardly as rod 63 pushes on base 32 toward an A-frame shape as described above and shown in FIG. 9. The handle 50 may then be used to push the sofa bed 100, 700 inwardly until the base 31 becomes the seat and the base 32 becomes the backrest once more. When the sofa bed 100, 700 approaches the complete sofa configuration, the clip 420 will once again engage the strut 57 and remain biased in the sofa configuration.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. A sofa bed configured to be installed in a recreational vehicle (RV) having a floor and a movable raised surface, the sofa bed extendable between a sofa configuration and a bed configuration, comprising:

a pair of armrests, wherein the pair of armrests form a notch configured to receive the movable raised surface therein and the pair of armrests are not configured to extend to the floor of the RV;

at least one first seat cushion disposed between the pair of armrests;

at least one first connector attached to each of the at least one first seat cushion;

at least one second seat cushion disposed between the pair of armrests;

at least one second connector attached to each of the at least one second seat cushion, wherein the at least one first connector and the at least one second connector form a hinge joint;

at least one third seat cushion disposed between the set of armrests;

a first seat base attached to the at least one first seat cushion;

a pair of stand bars supporting the first seat base;

a second seat base attached to the at least one second seat cushion;

a third seat base attached to the at least one third seat cushion, wherein the second seat base and the third seat base are connected in a hinge joint;

a pair of rotating shafts, each disposed in one of the armrests, wherein that third seat base is attached to rotating shafts opposite the hinge joint with the second seat base;

a pair of support legs configured to support the first seat base;

a pair of first slide rails, each attached to one of the pair of support legs;

a pair of first glide wheels, each connected to one of the first connectors, wherein each of the first slide rails is configured to receive the first glide wheel and allow the first glide wheel to roll along at least part of the length of the first slide rail to permit the sofa bed to transition between the sofa configuration and the bed configuration;

a pair of second slide rails, each attached to one of the pair of armrests; and a pair of second glide wheels, each of the second glide wheels connected to one of the first slides, wherein each of the second slide rails slides is configured to receive the second glide wheel and allow the second glide wheel to roll along at least part of the length of the second slide rail to permit the sofa bed to transition between the sofa configuration and the bed configuration.

2. The sofa bed of claim 1, wherein first seat base has a side distal to the second seat base and a side proximal to the second seat base; and wherein the second seat base includes a protrusion opposite the second seat cushion and further comprising:

at least one reinforcing rod having a first side and a second side, wherein the first side is attached to the corresponding distal side of the first seat base and the second side is attached to the corresponding proximal side of the first seat base;

at least one ratchet bracket having a bar with a long side and short side and comprising indentations along the long side, the short side being attached to the reinforcing rod and the long side being attached to the proximal side of the first seat base;

at least one locking rod having one end attached to the corresponding protrusion on the second seat base and the other end engaging the teeth of the ratchet bracket; and at least one slider stop surrounding a long side of one of the ratchet brackets and comprising a spring between the slider stop and the locking rod to apply force to maintain engagement between the teeth and the locking rod.

3. The sofa bed of claim 1, further comprising:

a support pad disposed on each of the first slides to support the second seat base and the third seat base.

4. The sofa bed of claim 1, further comprising:

a pair of first casters, each on one of the stand bars; and a pair of second casters, each on one of the support legs.

5. The sofa bed of claim 1, wherein the third seat base comprises a pair of connection plates and each of the rotating shafts connects to the third seat base at one of the connection plates.

6. The sofa bed of claim 1, further comprising a clip attached to the first seat base and a strut or crossbar attached to the second seat base, wherein the clip is configured to connect to the strut or crossbar and hold the sofa bed in a sofa position.

7. The sofa bed of claim 1, wherein the movable raised surface is a slide-out floor of the RV.

8. The sofa bed of claim 1, wherein a height of the notch is between 1 and 12 inches from the floor of the RV.

9. The sofa bed of claim 1, wherein the hinge joint between the first and second connectors allows the first and second connectors to rotate relative to each other such that at least the first and second seat cushions form a substantially planar surface in the bed configuration.

10. The sofa bed of claim 1, wherein the sofa bed is configured to be installed against a movable slide-out wall of the recreational vehicle.

11. A sofa bed configured to be installed in a recreational vehicle (RV) having a floor and a movable slide-out floor, the sofa bed extendable between a sofa configuration and a bed configuration, comprising:

a pair of armrests, wherein the pair of armrests form a notch configured to receive the movable slide-out floor therein and the pair of armrests are not configured to extend to the floor of the RV;

at least a first and second seat cushion disposed between the pair of armrests;

a pair of support legs each having a caster, wherein the support legs are configured to enable the sofa bed to glide between the sofa configuration and the bed configuration;

a pair of first slide rails, wherein each of the first slide rail is attached to one of the pair of support legs;

a pair of first glide wheels connected to the first seat cushion, wherein each of the first slide rails is configured to receive the first glide wheel and allow the first glide wheel to roll along at least part of the length of the first slide rail to move the support legs between the sofa configuration and the bed configuration;

a pair of second slide rails, wherein each of the second slide rails is attached to one of the pair of armrests; and a pair of second glide wheels connected to the second seat cushion, wherein each of the second slide rails is configured to receive the second glide wheel and allow the second glide wheel to roll along at least part of the length of the second slide rail to move the support legs between the sofa configuration and the bed configuration.

12. The sofa bed of claim 11, wherein a height of the sofa bed in the sofa configuration is the height of the notch.

13. The sofa bed of claim 11, further comprising:

at least one first connector attached to the at least one first seat cushion;

at least one second connector attached to the at least one second seat cushion, wherein the at least one first connector and the at least one second connector form a hinge joint.

14. The sofa bed of claim 13, wherein the hinge joint allows the first and second connectors to rotate relative to each other such that the at least first and second seat cushions form a substantially planar surface in the bed configuration.

15. The sofa bed of claim 11, further comprising:

a first seat base attached to the at least one first seat cushion; and a second seat base attached to the at least one second seat cushion.

16. The sofa bed of claim 15, further comprising:

at least one third seat cushion disposed between the set of armrests;

a third seat base attached to the at least one third seat cushion, wherein the second seat base and the third seat base are connected in a hinge joint.

17. The sofa bed of claim 16, further comprising:

a pair of rotating shafts, wherein each of the rotating shafts is disposed in one of the armrests, wherein that third seat base is attached to rotating shafts opposite the hinge joint with the second seat base.

18. The sofa bed of claim 15, wherein first seat base has a side distal to the second seat base and a side proximal to the second seat base; and wherein the second seat base includes a protrusion opposite the second seat cushion and further comprising:

at least one reinforcing rod having a first side and a second side, wherein the first side is attached to the corresponding distal side of the first seat base and the second side is attached to the corresponding proximal side of the first seat base;

at least one ratchet bracket having a bar with a long side and short side and comprising indentations along the long side, the short side being attached to the reinforcing rod and the long side being attached to the proximal side of the first seat base;

at least one locking rod having one end attached to the corresponding protrusion on the second seat base and the other end engaging the teeth of the ratchet bracket; and at least one slider stop surrounding a long side of one of the ratchet brackets and comprising a spring between the slider stop and the locking rod to apply force to maintain engagement between the teeth and the locking rod.

19. A method of extending a sofa bed configured to be installed in a recreational vehicle (RV) having a floor and a movable slide-out floor, the sofa bed extendable between a sofa configuration and a bed configuration, comprising:

installing a sofa bed against a movable slide-out wall of an RV and upon a movable slide-out floor, the sofa bed having a pair of armrests, wherein the pair of armrests form a notch and receive the movable slide-out floor therein, wherein the pair of armrests are not configured to extend to the floor of the RV, at least a first and second seat cushion disposed between the pair of armrests, a first seat base attached to the at least one first seat cushion and a second seat base attached to the at least one second seat cushion;

a pair of support legs each having a caster, wherein the support legs are configured to enable the sofa bed to glide between the sofa configuration and the bed configuration, a pair of first slide rails, wherein each of the first slide rail is attached to one of the pair of support legs, a pair of first glide wheels connected to the first seat cushion, wherein each of the first slide rails is configured to receive the first glide wheel and allow the first glide wheel to roll along at least part of the length of the first slide rail to move the support legs between the sofa configuration and the bed configuration, a pair of second slide rails, wherein each of the second slide rails is attached to one of the pair of armrests, and a pair of second glide wheels connected to the second seat cushion, wherein each of the second slide rails is configured to receive the second glide wheel and allow the second glide wheel to roll along at least part of the length of the second slide rail to move the support legs between the sofa configuration and the bed configuration;

lifting the first seat base in the sofa configuration and moving the first seat base away from the pair of armrests to allow the first and second glide wheels to roll along at least part of the length of the first and second slide rails to move the support legs along the movable slide-out floor to the bed configuration.

20. The method of extending a sofa bed of claim 19, wherein the sofa bed further comprises a handle attached to the first seat base; wherein the method includes grasping the handle to move the first seat base away from the pair of armrests.

* * * * *